US009040862B2

(12) United States Patent
Ryu

(10) Patent No.: US 9,040,862 B2
(45) Date of Patent: May 26, 2015

(54) ELECTRODE ASSEMBLY FOR VACUUM INTERRUPTER

(75) Inventor: Jae Seop Ryu, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 351 days.

(21) Appl. No.: 13/527,469

(22) Filed: Jun. 19, 2012

(65) Prior Publication Data

US 2012/0325778 A1 Dec. 27, 2012

(30) Foreign Application Priority Data

Jun. 23, 2011 (KR) ..... 10-2011-0061349

(51) Int. Cl.
*H01H 33/664* (2006.01)

(52) U.S. Cl.
CPC ..... *H01H 33/6643* (2013.01); *H01H 33/6644* (2013.01)

(58) Field of Classification Search
CPC ..... H01H 33/66; H01H 33/6642; H01H 33/6643; H01H 33/6644; H01H 33/6641
USPC ..... 218/129, 118–128
See application file for complete search history.

(56) References Cited

U.S. PATENT DOCUMENTS 3,622,724 A * 11/1971 Sofianek ..... 218/127
5,438,174 A * 8/1995 Slade ..... 218/118
5,646,386 A * 7/1997 Yorita et al. ..... 218/129
6,506,992 B2 * 1/2003 Kim ..... 218/123
8,263,894 B2 * 9/2012 Tak et al. ..... 218/123
2002/0043514 A1 4/2002 Kim

FOREIGN PATENT DOCUMENTS

| | | |
|---|---|---|
| CN | 2752943 | 1/2006 |
| CN | 101834086 | 9/2010 |
| DE | 19933495 | 1/2000 |
| EP | 0203367 | 12/1986 |
| JP | 50-121778 | 9/1975 |
| JP | 52-066961 | 6/1977 |

(Continued)

OTHER PUBLICATIONS

Japan Patent Office Application Serial No. 2012-139524, Office Action dated Jul. 16, 2013, 2 pages.

(Continued)

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

An electrode assembly for a vacuum interrupter is configured such that supporting members can support most of a contact electrode plate and a supporting electrode plate in an axial direction with coil conductors interposed therebetween. Accordingly, an impact generated between electrode assemblies upon a closing operation of the vacuum interrupter may be evenly distributed onto the supporting members, which may result in preventing each of the electrode plates and the coil conductors from being deformed. Also, the supporting members are inserted into the electrode plates and the coil conductors, thereby effectively preventing a current from flowing via the supporting members. In addition, the supporting member may be wide and large so as to simplify an assembly operation and reduce an assembly time.

13 Claims, 5 Drawing Sheets

(56) References Cited

FOREIGN PATENT DOCUMENTS

| | | |
|---|---|---|
| JP | 55-044594 | 3/1980 |
| JP | 59-000821 | 1/1984 |
| JP | 63-175308 | 7/1988 |
| JP | 1-164637 | 11/1989 |
| JP | 04-174919 | 6/1992 |
| JP | 5-190062 | 7/1993 |
| JP | 2009295436 | 12/2009 |
| JP | 2010-212229 | 9/2010 |

OTHER PUBLICATIONS

In the European Patent Office Application Serial No. 12172404.1, Search Report dated Sep. 12, 2012, 4 pages.
Japan Patent Office Application Serial No. 2012-139524, Notice of Allowance dated Nov. 19, 2013, 3 pages.
The State Intellectual Property Office of the People's Republic of China Application Serial No. 201210212362.8, Office Action dated Apr. 25, 2014, 6 pages.

* cited by examiner

ELECTRODE ASSEMBLY FOR VACUUM INTERRUPTER

CROSS-REFERENCE TO RELATED APPLICATION

Pursuant to 35 U.S.C. 119(a), this application claims the benefit of earlier filing date and right of priority to Korean Patent Application No. 10-2011-0061349, filed on Jun. 23, 2011, the contents of which are all hereby incorporated by reference herein in their entirety.

BACKGROUND OF THE INVENTION

1. Field of the Invention

This specification relates to an electrode assembly for a vacuum interrupter applied to a vacuum circuit breaker.

2. Background of the Invention

In general, a vacuum interrupter is an arc-extinguishing unit used as a core component of an electric power device such as a vacuum circuit breaker, a vacuum switch, a vacuum contactor or the like, in order to break an electric load current or a fault current in an electric power system.

Among such application devices of the vacuum interrupter, the vacuum circuit breaker serves to protect an electric load in power transmission controlling and the electric power system, and since the vacuum circuit breaker has many advantages in view of a large breaking capacity and high operational reliability and stability and can be mounted in a small space, the vacuum circuit breaker has been extensively applied in voltage environments from a middle voltage to a high voltage. Also, the breaking capacity of the vacuum circuit breaker is proportionally increasing in line with the increase in the size of industrial facilities.

A vacuum interrupter of a vacuum circuit breaker operates using a magnetic field, which is generated by a current flowing through an electrode structure therein upon breaking a fault current. According to a method of generating such a magnetic field, vacuum interrupters may be divided into an Axial Magnetic Field (AMF) type and a Radial Magnetic Field (RMF) type.

An ultrahigh-voltage vacuum interrupter exhibits a very wide interval between a fixed electrode and a movable electrode in a trip (open) state and a very fast closing speed, as compared with a low-voltage vacuum interrupter. Hence, an extremely strong impact is applied to an electrode upon a closing operation. Such impact may cause a contact electrode plate, coil conductors and a supporting electrode plate to be deformed when a supporting structure for the electrodes is not satisfactory. This deformation may lower a performance of the vacuum interrupter.

FIG. 1 is a longitudinal sectional view of a vacuum interrupter according to the related art.

As shown in FIG. 1, a vacuum interrupter according to the related art may include an insulating container 1 sealed by a fixed side flange 2 and a movable side flange 3, a fixed electrode assembly 4 and a movable electrode assembly 5 received in an inner shield 6, which is fixed to an inside of the insulating container 1, and contactably facing each other, a fixing shaft 4*a* of the fixed electrode assembly 4 fixed onto the fixed side flange 2 and connected to the exterior, and a movable shaft 5*a* of the movable electrode assembly 5 slidably coupled to the movable side flange 3 and connected to the exterior.

A bellows shield 7 may be fixed onto the movable shaft 5*a* of the movable electrode assembly 5 and a bellows 8 may be disposed between the bellows shield 7 and the movable side flange 3, which allows the movable shaft 5*a* of the movable electrode assembly 5 to be movable within the insulating container 1 in a sealed state.

Here, since the fixed electrode assembly 4 and the movable electrode assembly 5 are symmetrical to each other, they are referred to as an electrode assembly 10 for explanation, hereinafter. FIG. 2 is a disassembled perspective view of the electrode assembly according to the related art.

As shown in FIG. 2, the electrode assembly 10 may include a plurality of coil conductors 131 and 135 installed between a contact electrode plate 11 and a supporting electrode plate 12, and conductor connection pins 14*a* to 14*d* installed between the contact electrode plate 11 and the coil conductors 131 and 135 or between the supporting electrode plate 12 and the coil conductors 131 and 135, respectively. The contact electrode plate 11, the coil conductors 131 and 135 and the supporting electrode plate 12 may be connected together via the conductor connection pins 14*a* and 14*d*, thereby defining a conductive path of a current.

Here, the contact electrode plate 11 and the supporting electrode plate 12 may include slits 11*a* and 12*a* (hereinafter, a slit formed at the contact electrode plate 11 is referred to as a contact side slit, and a slit formed at the supporting electrode plate is referred to as a supporting side slit) formed in a radial direction for preventing generation of an eddy current. In the AMF type vacuum interrupter, the contact side slits 11*a* and the supporting side slits 12*a* may be located in an alternating manner to create an axial magnetic flux.

Supporting pins 15*a* to 15*d* may be installed between the conductor connection pins 14*a* to 14*d* to prevent the electrode plates 11 and 12 or the coil conductors 131 and 135 from being deformed due to an impact between electrodes, which is generated upon a closing operation. The supporting pins 15*a* to 15*d* may be installed adjacent to sides of the contact side slits 11*a* and the supporting side slits 12*a*, so as to prevent deformation due to such an impact.

An unexplained reference number 16 denotes a central support, which is installed between the contact electrode plate 11 and the supporting electrode plate 12 to support a central portion.

In the electrode assembly of the vacuum interrupter according to the related art, the supporting pins 15*a* to 15*d* are installed near the contact side slits 11*a* and the supporting side slits 12*a* to prevent the deformation of the electrode plates 11 and 12 due to an impact between electrodes. However, as the contact side slits 11*a* and the supporting side slits 12*a* are formed in the alternating manner, the supporting pins 15*a* to 15*d*, which are located at both sides of the coil conductors 131 and 135 based on an axial direction, are also alternately installed. Consequently, impacts which are generated when the electrode assemblies 4 and 5 contact each other are applied at different positions. This may result in deformation of the contact electrode plate 11 and the supporting electrode plate 12 as well as the coil conductor 13 of the electrode assembly.

Also, when the number of supporting pins 15*a* to 15*d* increases to prevent the deformation, the number of components increases as well and stages of a fabricating process become complicated.

SUMMARY OF THE INVENTION

Therefore, an aspect of the detailed description is to provide an electrode assembly for a vacuum interrupter, capable of preventing coil conductors, a contact electrode plate or a supporting electrode plate from being deformed due to a strong impact applied to electrodes upon a closing operation of the vacuum interrupter.

Another aspect of the detailed description is to provide an electrode assembly for a vacuum interrupter, capable of preventing beforehand an increase in the number of components or the number of stages of a fabricating process so as to avoid the deformation.

To achieve these and other advantages and in accordance with the purpose of this specification, as embodied and broadly described herein, there is provided an electrode assembly for a vacuum interrupter including a plurality of electrode plates each having slits, coil conductors disposed between the plurality of electrode plates, a plurality of conductor connection pins installed between each electrode plate and the coil conductors to define conductive paths of a current, and supporting members installed between each electrode plate and the coil conductors to support the electrode plates with respect to the coil conductors, wherein the supporting members installed at both sides of the coil conductors may be partially overlapped by each other when being projected in an axial direction.

Here, at least one of the supporting members may be located to cross the slits of the electrode plates.

The slits of each electrode plate may be radially formed with a uniform interval along a circumferential direction, and the supporting members disposed at the both sides may be installed so that both ends can be located at different positions when being projected in the axial direction.

At least one of the supporting members may be formed to be longer than a circumferential length between two adjacent slits in a circumferential direction.

The supporting members may be provided in plurality between each electrode plate and the coil conductors, respectively, and the plurality of supporting members may be symmetrical to each other and each may have an arcuate shape.

Fixing recesses may be formed at at least one of the electrode plates and the coil conductors, and the supporting members may be inserted into the fixing recesses.

A depth of each fixing recess may be shallower than a thickness of each supporting member.

The fixing recesses may be provided in plurality, so as to be symmetrical to each other on the same plane, and pin holes for coupling of the conductor connection pins may be formed between the plurality of fixing recesses.

The pin holes may be formed at both sides of the coil conductors in an axial direction, and the pin holes formed at both sides of the coil conductors may be located on different axial lines.

The supporting members may be brazed onto at least one of the electrode plates and the coil conductors.

Slits of the both electrode plates located at both sides of the coil conductors may be formed on different lines based on an axial direction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an electrode assembly for a vacuum interrupter in accordance with the exemplary embodiments, with reference to the accompanying drawings. For the sake of brief description with reference to the drawings, the same or equivalent components will be provided with the same reference numbers, and description thereof will not be repeated.

Figure 3:
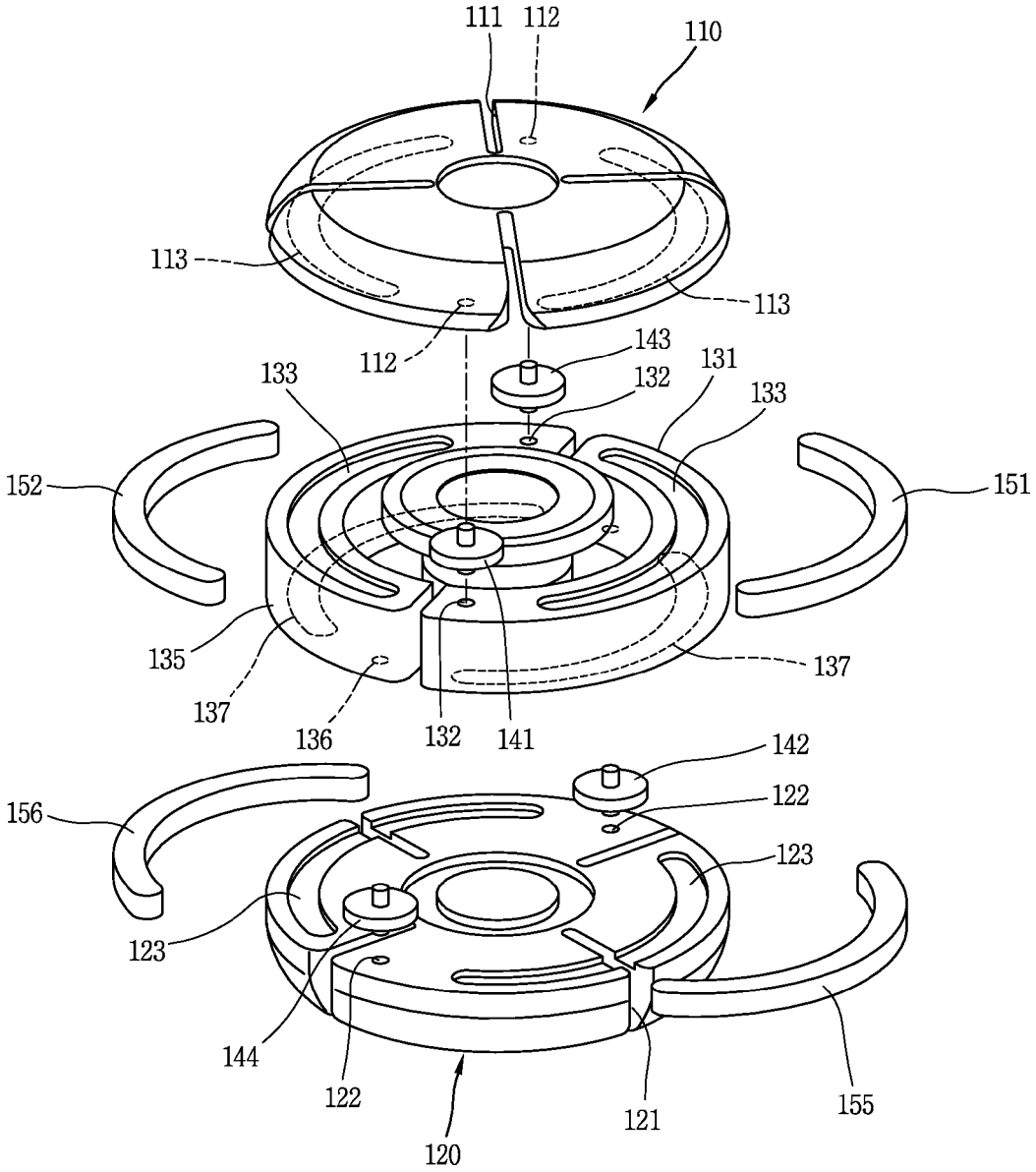
FIG. 3 is a disassembled perspective view of an electrode assembly in accordance with one exemplary embodiment of the present disclosure.
Figure 4:
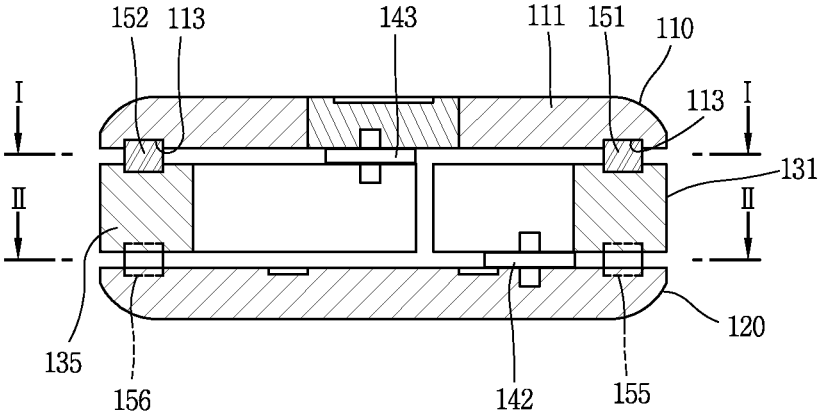
FIG. 4 is an assembled sectional view of the electrode assembly shown in FIG. 3.
Figure 5:
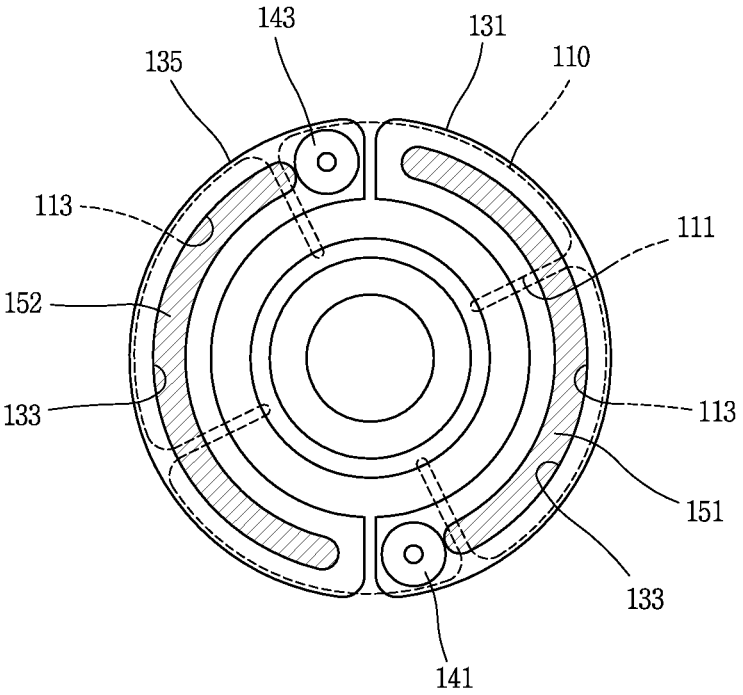
FIGS. 5 and 6 are sectional views taken along the lines "I-I" and "II-II" shown in FIG. 4.
Figure 6:
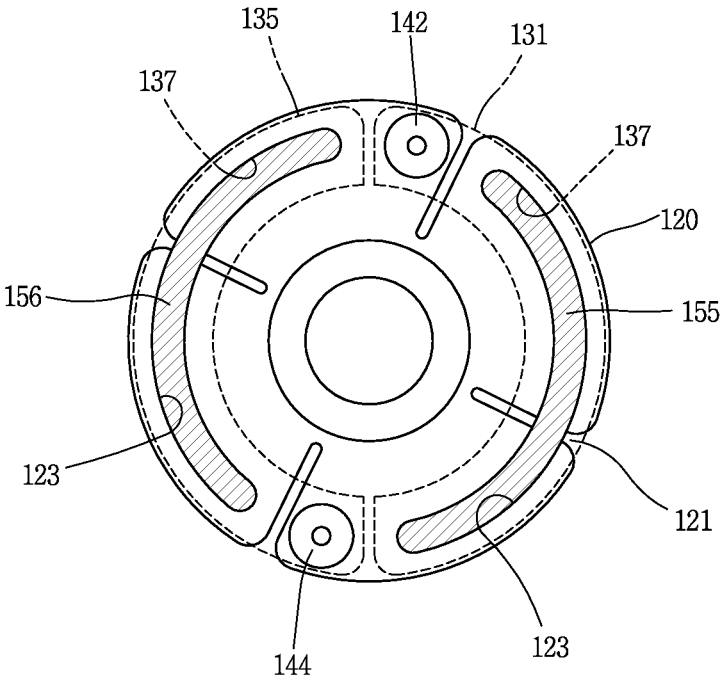
Figure 7:
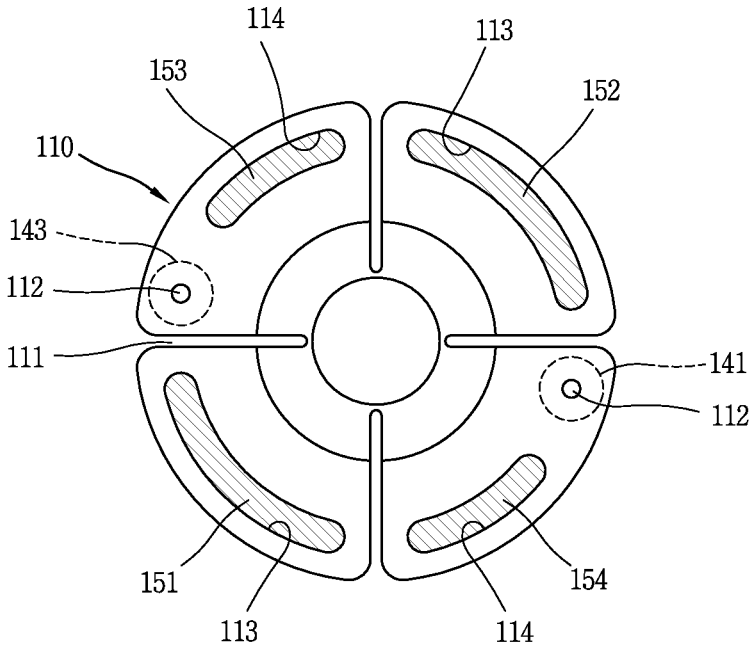
FIG. 7 is a planar view of an electrode assembly in accordance with another exemplary embodiment of the present disclosure.

FIG. 3 FIG. 3 is a disassembled perspective view of an electrode assembly in accordance with one exemplary embodiment of the present disclosure, FIG. 4 is an assembled sectional view of the electrode assembly shown in FIG. 3, and FIGS. 5 and 6 are sectional views taken along the lines "I-I" and "II-II" shown in FIG. 4.

Figure 1:
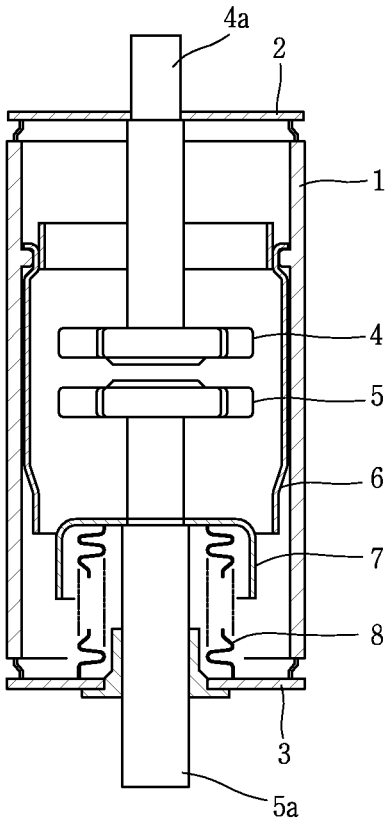
FIG. 1 CONVENTIONAL ART
FIG. 1 is a sectional view of a vacuum interrupter according to the related art.

Referring back to FIG. 1, a vacuum interrupter having an electrode assembly according to the present disclosure may include an insulating container 1, a fixed side flange 2, a movable side flange 3, a fixed electrode assembly 4, a movable electrode assembly 5, an inner shield 6, a bellows shield 7 and a bellows 8.

The fixed electrode assembly 4 and the movable electrode assembly 5 may face each other in an axial direction. Accordingly, upon an occurrence of a fault current, the movable electrode assembly 5 may move in the axial direction to be separated from the fixed electrode assembly 4, thereby overcoming the fault current.

Here, since the fixed electrode assembly 4 and the movable electrode assembly 5 are symmetrical to each other, hereinafter, they will be referred to as an electrode assembly for explanation.

Figure 2:
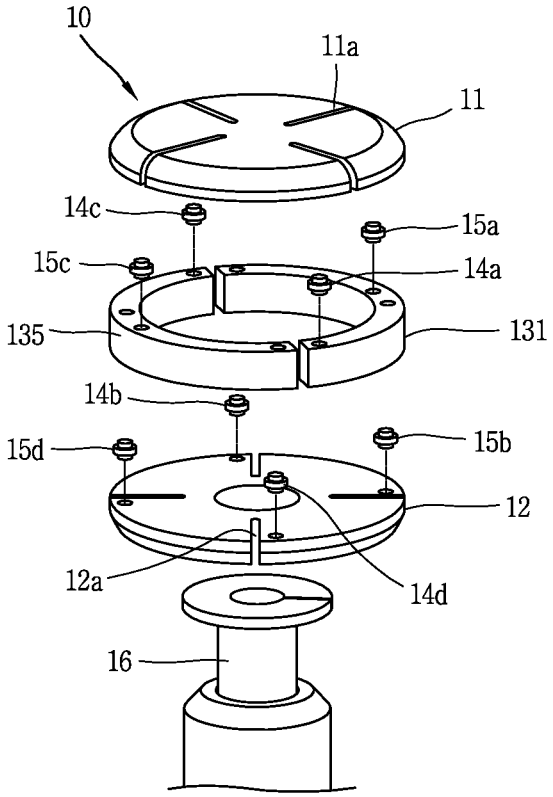
FIG. 2 CONVENTIONAL ART
FIG. 2 is a disassembled perspective view showing an electrode assembly of the vacuum interrupter shown in FIG. 1.

As shown in FIGS. 3 and 4, an electrode assembly according to the present disclosure may include a contact electrode plate 110 contacting a top of a support 16 (see FIG. 2) and facing the other electrode assembly, a supporting electrode plate 120 disposed with a predetermined interval from the contact electrode plate 110 and contacting the support 16, a plurality of coil conductors 131 and 135 located between the contact electrode plate 110 and the supporting electrode plate 120 and provided as a pair at left and right sides, a plurality of contact side conductor connection pins (hereinafter, referred to as first connection pins) 141 and 143 located between the contact electrode plate 110 and the coil conductors 131 and 135 to define a conductive path of a current, and a plurality of supporting side conductor connection pins (hereinafter, referred to as second connection pins) 142 and 144 located between the supporting electrode plate 120 and the coil conductors 131 and 135 to define a conductive path of a current.

The contact electrode plate 110 may have a disc-like shape, and include contact side slits (hereinafter, referred to as first slits) 111 radially formed by intervals of 90° therebetween along a circumferential direction for preventing a generation of an eddy current. A plurality of contact side pin holes (hereinafter, referred to as first pin holes) 112 for coupling of the first connection pins 141 and 143 may be formed by a phase difference of 180° at one side surface of the contact electrode plate 110, namely, a surface facing the coil conductors 131 and 135. A plurality of contact side fixing recesses (hereinafter, referred to as first fixing recesses) 113 for insertion of one side surface of each contact side supporting member (hereinafter, referred to as a first supporting member) 151 and 152, which will be explained later, may be formed between the first pin holes 112.

Each of the first fixing recesses 113 may have an arcuate shape. The first fixing recesses 113, as shown in FIG. 5, may be alternatively formed to cross the first slits 111. When the first fixing recesses 113 cross the first slits 111, the pair of first supporting members 151 and 152 may be formed to be symmetrical to each other in left and right directions.

Here, the first supporting members 151 and 152 may have the same shape as the shape of the first fixing recess 113. The first supporting members 151 and 152 may preferably be formed of a nonconductor or a metal having extremely high electric resistance to prevent a current transferred from the contact electrode plate 110 to the first connection pins 141 and 143 from being transferred to another conductive path via supporting side supporting members 155 and 156, which will be explained later.

The first supporting members 151 and 152 may be preferably formed of a material having a predetermined rigidity, so as to bear an impact, which is generated when the contact electrode plate 110 contacts a counterpart electrode assembly, thereby preventing deformation of portions of the contact electrode plate 110 adjacent to the slits 111. The first supporting member 151 and 152 may be formed to be longer than a circumference between the two slits 111 adjacent to each other in a circumferential direction.

The supporting electrode plate 120, as shown in FIG. 6, may be formed in a similar shape to the contact electrode plate 110. That is, the supporting electrode plate 120 may include supporting side slits (hereinafter, referred to as second slits) 121 to correspond to the first slits 111, and supporting side pin holes (hereinafter, referred to as second pin holes) 122 and supporting side fixing recesses (hereinafter, referred to as second fixing recesses) 123 both formed at one surface of the supporting electrode plate 120, namely, a surface corresponding to the coil conductors 131 and 135 to correspond to the first pin holes 112 and the first fixing recesses 113 of the contact electrode plate 110. Here, the second slit 121, the second pin hole 122 and the second fixing recess 123 may not be located on one line with the first slit 111, the first pin hole 112 and the first fixing recess 113 in an axial direction, but biased from the first slit 111, the first pin hole 112 and the first fixing recess 113 by predetermined angles. This allows for defining a different conductive path to form an axial magnetic field.

The coil conductors 131 and 135, as shown in FIG. 5, may be formed in an arcuate shape as a pair in left and right directions. Both ends of each coil conductor 131 and 135 may be coupled to be located between the slit 111 of the contact electrode plate 110 and the slit 121 of the supporting electrode plate 120. A plurality of first coil side pin holes 132 for coupling of the first connection pins 141 and 143 may be formed at one surface of each coin conductor 131 and 135, namely, a surface facing the first fixing recesses 113 of the contact electrode plate 110. The plurality of first coil side pin holes 132 may correspond to the first pin holes 112. First coil side fixing recesses 133, in which another surfaces of the first supporting members 151 and 152 are inserted, may be formed to correspond to the first fixing recesses 113.

Second coil side pin holes 136 corresponding to the first coil side pin holes 132 may be formed at another surfaces of the coil conductors 131 and 135, namely, surfaces corresponding to the supporting electrode plate 120, and second coil side fixing recesses 137 may be formed between the second coil side pin holes 136 in a circumferential direction. The second coil side fixing recesses 137 may be formed to correspond to the second fixing recesses 123. However, the second coil side pin holes 136 may not be located on one line with the first coil side pin holes 132 in an axial direction but biased from each other by a predetermined angle, so as to define a different conductive path to form an axial magnetic field. Similarly, the second coil side fixing recesses 137 may be biased from the first coil side fixing recesses 133 by a predetermined angle.

The supporting side supporting members (hereinafter, referred to as second supporting members) 155 and 156 may be located between the supporting electrode plate 120 and the coil conductors 131 and 135. The second supporting members 155 and 156 may have the same shape as the first supporting members 151 and 152. Here, the second supporting members 155 and 156 may be installed such that centers thereof can be biased from centers of the first supporting members 151 and 152 in an axial direction by predetermined angles.

Here, in order for the contact electrode plate 110 and the coil conductors 131 and 135 or the supporting electrode plate 120 and the coil conductors 131 and 135 to maintain a predetermined interval therebetween without contact with each other, a thickness of each of the first and second supporting members 151, 152, 155 and 156 may preferably be thicker than a total depth of the first fixing recess 113 and the first coil side fixing recess 133 or a total depth of the second fixing recess 123 and the second coil side fixing recess 137.

In the electrode assembly of the vacuum interrupter according to the exemplary embodiment, the first supporting members 151 and 152 and the second supporting members 155 and 156 may formed in an arcuate shape, and installed such that both surfaces thereof can contact the contact electrode plate 110 and one surface (an upper surface in the drawing) of the coil conductors 131 and 135 and the supporting electrode plate 120 and another surface (a lower surface in the drawing) of the coil conductors 131 and 135. The supporting members 151 and 152 and the second supporting members 155 and 156 may also be installed to support the contact electrode plate 110 and the supporting electrode plate 120 by partially crossing the first slits 111 of the contact electrode plate 110 and the second slits 121 of the supporting electrode plate 120.

Accordingly, the first supporting members and the second supporting members may support most parts of the contact electrode plate and the supporting electrode plate in an axial direction with interposing the coil conductors therebetween. This may allow an impact generated between the electrode assemblies upon a closing operation of the vacuum interrupter to be evenly distributed to the first and second supporting members, thereby mitigating the impact. Accordingly, even when the electrode assemblies contact each other at a fast speed, the contact electrode plate, the coil conductors and the supporting electrode plate may be effectively prevented from being deformed due to such an impact.

Also, the first supporting members and the second supporting members of the electrode assembly may be inserted for coupling into the recesses formed at the contact electrode plate, the coil conductors and the supporting electrode plate, other than completely contacting each electrode plate through brazing. This may effectively prevent a current from flowing through the first and second supporting members, thereby enhancing reliability of the electrode assembly.

The electrode assembly according to the present disclosure may employ wide supporting members, which may result in facilitation of an assembly operation and a time reduction for the assembly operation as compared with using the small supporting pins as in the related art.

Hereinafter, description will be given of an electrode assembly for a vacuum interrupter according to another exemplary embodiment.

That is, the aforementioned exemplary embodiment has illustrated that a pair of supporting members are formed and installed to partially cross slits. However, in this another exemplary embodiment, first supporting members 151, 152, 153 and 154 and second supporting members (not shown) may be located between first slits 111 or between second slits (not shown).

In this structure, four contact side supporting members 151 to 154 may be symmetrical in a diagonal direction.

The electrode assembly according to the another exemplary embodiments may further improve a performance of a circuit breaker, as compared with the aforementioned exemplary embodiment, in view of blocking a conductive path of an eddy current in advance.

That is, in the aforementioned exemplary embodiment, the supporting members 151, 152, 155, 156 are installed to cross the slits 111 and 121, which may result in effectively preventing deformation of portions adjacent to the slits 111 and 121 upon a closing operation of the vacuum interrupter. However, when an eddy current is generated on the contact electrode plate 110 or the supporting electrode plate 120, the supporting members 151, 152, 155, 156 may act as a conductive path of the eddy current.

On the contrary, as shown in the another exemplary embodiment, when the supporting members 151 to 154 are installed to be located between the slits 111 without crossing the slits 111, the supporting members 151 to 154 may be prevented from acting as a conductive path of an eddy current although they exhibit a lower supporting force than those in the aforementioned embodiment in view of the deformation at the portions adjacent to the slits 111.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electrode assembly for a vacuum interrupter, the electrode assembly comprising:

a plurality of electrode plates comprising a first electrode plate and a second electrode plate each comprising a plurality of slits and a plurality of fixing recesses;

a plurality of coil conductors disposed between the first electrode plate and the second electrode plate, a coil conductor of the plurality of coil conductors comprising a first coil-side fixing recess on a first side facing the first electrode plate and a second coil-side fixing recess on a second side facing the second electrode plate;

a plurality of conductor connection pins disposed between the first electrode plate and the plurality of coil conductors and between the second electrode plate and the plurality of coil conductors to define a conductive path of a current;

a plurality of supporting members disposed between the first electrode plate and the plurality of coil conductors and between the second electrode plate and the plurality of coil conductors;

a first supporting member of the plurality of supporting members secured between the first coil-side fixing recess and a corresponding one of the plurality of fixing recesses of the first electrode plate; and a second supporting member of the plurality of supporting members secured between the second coil-side fixing recess and another corresponding one of the plurality of fixing recesses of the second electrode plate, wherein the first supporting member of the plurality of supporting members and the second supporting member of the plurality of supporting members are partially overlapped when projected in an axial direction.

2. The assembly of claim 1, wherein at least one of the plurality of fixing recesses of each of the plurality of electrode plates is configured to intersect at least one of the corresponding plurality of slits.

3. The assembly of claim 2, wherein:

the plurality of slits of each of the plurality of electrode plates are radially formed and disposed at a uniform interval along a circumference of the corresponding electrode plate; and the first supporting member and the second supporting member of the corresponding electrode plate are located at offset positions when projected in the axial direction.

4. The assembly of claim 1, wherein at least one of the plurality of supporting members is longer than a circumferential length between two adjacent slits.

5. The assembly of claim 1, wherein each of the plurality of supporting members of each of the plurality of electrode plates has an arcuate shape.

6. The assembly of claim 1, wherein a depth of each of the plurality of fixing recesses of each of the plurality of electrode plates is shallower than a thickness of the corresponding first supporting member or the corresponding second supporting member.

7. The assembly of claim 1, wherein:

the first electrode plate further comprises pin holes located between the corresponding plurality of fixing recesses; and each of the plurality of fixing recesses is configured to receive a conductor connection pin for coupling the first electrode plate to a corresponding coil conductor of the plurality of coil conductors.

8. The assembly of claim 7, wherein the coil conductor of the plurality of coil conductors further comprises coil-side pin holes at the first side and the second side, and each of the coil-side pin holes at the first side are located on different axial lines than the corresponding coil-side pin holes at the second side.

9. The assembly of claim 1, wherein the plurality of supporting members are brazed onto the corresponding first or second electrode plates and a corresponding one of the plurality of coil conductors.

10. The assembly of claim 1, wherein the plurality of slits of the first electrode plate are offset in an axial direction from the corresponding plurality of slits of the second electrode plate.

11. An electrode assembly for a vacuum interrupter, the electrode assembly comprising:

a first electrode plate and a second electrode plate;

a plurality of coil conductors disposed between the first and second electrode plates, each of the plurality of coil conductors comprising a plurality of first coil-side fixing recesses facing the first electrode plate and a plurality of second coil-side fixing recesses facing the second electrode plate;

conductor connection pins coupling each of the plurality of coil conductors with each of the corresponding first electrode plate and second electrode plate and positioned between each of the corresponding fixing recesses of the plurality of first and second coil-side fixing recesses; and supporting members formed of a nonconductive material in an arcuate shape and each partially secured within a corresponding one of the plurality of first coil-side fixing recesses or within a corresponding one of the plurality of second coil-side fixing recesses;

wherein the first and second electrode plates each comprise a plurality of fixing recesses each configured to partially receive a supporting member and align with a corresponding one of the plurality of first and second coil-side fixing recesses.

12. The assembly of claim 11, wherein positions of each of the supporting members secured within the first coil-side fixing recesses are offset in an axial direction from positions of the each of the supporting members secured within the corresponding second coil-side fixing recesses.

13. The assembly of claim 11, wherein:

the first and second electrode plates each comprise a plurality of slits formed radially at a uniform interval along a circumference of the corresponding electrode plate, and each of the plurality of slits is intersected by a supporting member.

* * * * *